US010760190B2

(12) United States Patent
Rasch

(10) Patent No.: US 10,760,190 B2
(45) Date of Patent: Sep. 1, 2020

(54) METHOD FOR KNITTING WITH A SOCK KNITTING NEEDLE

(71) Applicant: Sylvia Rasch, Berlin (DE)

(72) Inventor: Sylvia Rasch, Berlin (DE)

( * ) Notice: Subject to any disclaimer, the term of this patent is extended or adjusted under 35 U.S.C. 154(b) by 0 days.

(21) Appl. No.: 16/294,800

(22) Filed: Mar. 6, 2019

(65) Prior Publication Data

US 2019/0203391 A1 Jul. 4, 2019

Related U.S. Application Data

(63) Continuation of application No. PCT/EP2018/053276, filed on Feb. 9, 2018.

(30) Foreign Application Priority Data

Mar. 10, 2017 (DE) ..... 20 2017 001 294 U

(51) Int. Cl.
*D04B 3/02* (2006.01)

(52) U.S. Cl.
CPC ..... *D04B 3/02* (2013.01)

(58) Field of Classification Search
CPC ..... D04B 3/02
USPC ..... 66/117, 118, 123
See application file for complete search history.

(56) References Cited

U.S. PATENT DOCUMENTS 1,286,125 A * 11/1918 Sessions ..... D04B 17/04 66/117
1,313,461 A 8/1919 Brown
1,989,352 A * 1/1935 Davis ..... D04B 3/02 66/117
1,999,691 A * 4/1935 Ghaham ..... D04B 3/02 66/117
2,043,958 A * 6/1936 Engel ..... D04B 17/04 66/117
2,045,267 A * 6/1936 Graham ..... D04B 3/02 66/117
2,059,968 A * 11/1936 Febvre ..... D04B 17/04 66/117
2,061,282 A * 11/1936 Leboff et al. ..... D04B 17/04 66/117
2,067,197 A * 1/1937 Maiden ..... D04B 17/04 66/117

(Continued)

FOREIGN PATENT DOCUMENTS

DE 28 53 701 A1 7/1980
DE 87 08 212.8 U1 9/1987

(Continued)

*Primary Examiner* — Danny Worrell
(74) *Attorney, Agent, or Firm* — Seed IP Law Group LLP

(57) ABSTRACT

The present disclosure relates to a knitting needle for a knitting set for producing cross-sectionally round knitted products, having a first leg extending in a variable manner from a bendable shaft portion in a first extension direction to a first free end suitable for holding stitches, and a second leg extending in a variable manner from the bendable shaft portion in a second extension direction to a second free end suitable for holding stitches, wherein the free ends are in the form of rounded tips, and wherein the center of gravity of the knitting needle is arranged within the shaft portion, wherein the first extension direction and the second extension direction are at a variable angle to one another.

19 Claims, 3 Drawing Sheets

(56) References Cited

U.S. PATENT DOCUMENTS

| | | | | |
|---|---|---|---|---|
| 2,633,720 | A * | 4/1953 | Robbins | D04B 3/02 66/117 |
| 3,280,595 | A * | 10/1966 | Linstead | D04B 3/00 66/117 |
| 4,007,610 | A * | 2/1977 | Linstead | D04B 3/00 66/117 |
| 4,195,496 | A | 4/1980 | Vasquez et al. | |
| 4,501,133 | A * | 2/1985 | Kretzschmar | D04B 33/00 66/117 |
| 4,646,543 | A * | 3/1987 | Okada | D04B 3/02 66/117 |
| 4,680,947 | A * | 7/1987 | Phipps, Sr. | D04B 3/02 66/117 |
| 4,693,094 | A * | 9/1987 | Kahn | D04B 3/02 66/117 |
| 5,720,187 | A | 2/1998 | Matuo | |
| 6,397,640 | B1 | 6/2002 | Williams | |
| 6,983,627 | B1 | 1/2006 | Eley-Holden-Sotnik | |
| 7,954,342 | B2 * | 6/2011 | Devagnanam | D04B 3/02 66/117 |
| 8,210,003 | B2 * | 7/2012 | Zheng | D04B 3/02 66/117 |
| D735,469 | S | 8/2015 | Rastogi | |
| 2011/0197636 | A1 * | 8/2011 | Selter | D04B 3/02 66/117 |
| 2014/0202215 | A1 * | 7/2014 | Zorbach | D04B 3/02 66/117 |

FOREIGN PATENT DOCUMENTS

| | | |
|---|---|---|
| DE | 33 31 243 C2 | 4/1988 |
| DE | 196 32 578 C2 | 6/2001 |
| DE | 20 2009 003 346 U1 | 6/2009 |
| DE | 10 2011 119 818 B3 | 10/2012 |
| DE | 10 2015 103 592 B3 | 1/2016 |
| DE | 20 2016 007 702 U1 | 3/2017 |

* cited by examiner

Exploded view

The list of reference signs of Figure 1 applies accordingly

METHOD FOR KNITTING WITH A SOCK KNITTING NEEDLE

BACKGROUND

Technical Field

The disclosure relates to a bendable knitting needle for a set of knitting needles for producing cross-sectionally round knitted products.

Furthermore, the disclosure relates to a knitting set made up of 3 such knitting needles.

Description of the Related Art

In order to knit knitted products with a round cross section, in which the diameter of the cross section is relatively large (for example pullovers), circular knitting needles are used, in which leg-like portions with the free ends of the circular knitting needle are connected together for example via a flexible nylon cord. The stitches are located mainly on the circular knitting needle during knitting. In order to knit knitted products with a smaller diameter of the round cross section, sets of knitting needles made up of 5 rigid needles are usually used, wherein the rigid needles extend rectilinearly from their first free end to their second free end via the central shaft portion. In order to knit for example a leg region of a sock, the stitches are first of all distributed uniformly between four of the five needles. The stitches of the first needle carrying the end stitch are then knitted fully onto the free fifth needle, forming new stitches, until the first needle is free. Then, the stitches located on the second needle are knitted fully onto the free first needle and so on. In order to knit a round, the needles have to be changed four times. The number of rounds is as desired.

At the same time, there are also sets of knitting needles which make do with 3 knitting needles, since in this respect there is a rigid bend in the knitting needles. This is disclosed in DE 10 2015 103 592 B3.

The German Patent and Trademark Office has also identified the following prior art during the search in respect of the priority application of the present application: DE 33 31 243 C2, DE 196 32 578 C2, DE 28 53 701 A1, DE 87 08 212 U1 and U.S. Pat. No. 735,469 S, which relate in each case only to circular knitting needles, however, not sock knitting needles.

This results in the problem that, in addition to a possibly increased number of knitting needles, the inclination angle in the rigidly bent knitting sets is already defined and so no consideration is given to the ergonomics for different hands. Therefore, as a result of the rigid inclination angle, it is sometimes even possible for minor injuries (stabbing or jabbing of the needles) to occur on account of carelessness on the part of the user when using a knitting set. Moreover, rigid curved needles take up space and are of bulky design.

Furthermore, with a rigidly curved needle, compared with a straight knitting needle, it is difficult to professionally knit for example a sock heel, since a sock heel is usually worked as a straight section in the case of heels with a heel flap or, for heels with short rows/boomerang heels, as a succession of 2 trapezoids, and straight needles are most suitable for the heel-flap heels and straight portions are not reproduced on curved needles. With preshaped needles, there is the risk of the stitches being excessively stretched and then appearing unprofessionally larger in the knitted item.

In the case of very small diameters (children's socks), finally, there is the problem that a rigid set of knitting needles with three needles specifies the diameter, since at least half of the rigid bend represents the radius for the product to be knitted.

Although the knitting needles known from the prior art have a degree of popularity and are clearly usable for the intended purpose, they have the serious drawbacks that are not exhaustively mentioned above.

Therefore, the disclosure is based on the object of developing a knitting needle form which avoids the drawbacks of the prior art, allows bendability when knitting between the hands, or curved outwardly away from the hands or inwardly between the hands, reduces the changing of knitting needles for cross-sectionally round knitted products, and with which in particular knitted products with a smaller diameter of the round cross section can be produced easily, and ensures convenient transport since the bendable knitting needles are straight when not in use and can be transported in a flat and narrow manner without taking up much space.

This object is achieved according to the disclosure by the features of claim 1 and by a knitting set having the features of claim 11.

BRIEF SUMMARY

Accordingly, the subject of the disclosure is a bendable knitting needle, in particular a sock knitting needle, for circular or cylindrical textiles. This is not known from the prior art.

The bendability according to the disclosure of the knitting needles on account of a bendable central part between the shaft portions makes it possible for a knitted product with a round cross section to be produced with only three knitting needles. The stitches are, to this end, first of all distributed equally on two knitting needles and then knitted alternately using the third knitting needle, meaning that the knitting needles have to be exchanged less frequently, namely only twice per round. As a result of the bendability according to the disclosure, the legs of just two knitting needles can be aligned with one another such that the stitches carried on the knitting needles are arranged circularly in a manner corresponding approximately to the cross section of the subsequent knitted product. The individual angle furthermore prevents the knitting from being tensioned and the further knitting process thus being impaired or even prevented. Furthermore, it is thus possible for knitted products with a smaller diameter to be produced more easily. Compared with rectilinear needles for a knitting set, the advantage also arises that the stitches do not slip so easily off the knitting needle during knitting and/or after a knitting pause. During the knitting of a boomerang heel, the bendability according to the disclosure is likewise beneficial since, for this purpose, a trapezoid has to be formed and the needles according to the disclosure are adapted individually to the shape of the trapezoid and are thus most suitable in order not to stretch the stitches.

A knitting set has exactly 3 knitting needles according to the disclosure. There could also be more, but 3 are enough.

In the present disclosure, the extension direction of each particular leg relates in particular to the longitudinal direction thereof.

In an advantageous embodiment, the shaft portion and/or the two legs have a cylindrical cross section, wherein the free ends of the two legs are formed so as to taper toward the outside in cross section. This is advantageous since it is easier to cast on during the knitting process and even tightly knitted stitches can be knitted further. The cylindrical cross section serves for easy and low-wear stitch guidance during the knitting operation. The shaft portion and/or the two legs and/or the free ends can be formed in an internally hollow or solid manner or a combination thereof. Of course, the cross section of the knitting needle according to the disclosure is not limited to round but can be extended to other designs.

Preferably, the cross section of the shaft portion and of the two legs is formed in a round manner and corresponds in terms of diameter to the needle thickness. In this embodiment, the needle thickness has a size of usually 1 mm-4.5 mm. Preferably, a needle thickness of up to 7 mm in diameter is proposed. Greater needle thicknesses of up to 15 mm are likewise possible, in which case, however, the cable length increases slightly in the middle. Other cross sections, for example quadrilateral and triangular, are conceivable. According to one embodiment, other polygonal shapes are proposed, for example an octagonal cross-sectional shape.

In a further advantageous embodiment of the present disclosure, the two legs with their free ends are substantially the same length and preferably each have a length of 5 cm to 15 cm and particularly preferably a length of 7 cm to 8.5 cm.

Preferably, the connection between the knitting-needle parts is 3-5 cm long and consists of a nylon cord or nylon-coated wire mesh. According to one embodiment, the connection between the knitting needles can be up to 6 cm or 7 cm long.

In the simplest case, the shaft portion has a continuous round cross section. It is furthermore conceivable for the lengths of the legs to vary and/or have a different size.

In a further advantageous embodiment, the shaft portion and/or at least one of the two legs, preferably both, and/or the respective free ends thereof exhibit natural and/or synthetic materials.

Preferably, the materials are selected from the group consisting of wood, horn, metal, in particular aluminum, plastics, bamboo, composite materials and/or a combination thereof. This is advantageous since the knitting needle is universally usable and is not limited depending on the material to be knitted.

According to one embodiment, it is proposed that brass be the metal used as the material for the legs, in particular in each case a brass tube. Preferably, a high-tech plastic as composite material is also proposed as material for the legs, in particular a carbon-fiber reinforced plastic.

According to the disclosure, the shaft portion is formed in a bendable manner. As described, this is provided particularly such that the shaft portion can be bent elastically and in particular with little force. This can be achieved particularly through the use of nylon as the material for the bendable shaft portion. The knitting needle adapts to the round knitting as a result, specifically particularly on its own. As a result of its round shape, the knitting also determines the bend of the knitting needles on which some of the stitches of the knitting are located. During knitting, the stitches are located particularly on two knitting needles and are knitted off one with a third knitting needle, and as a result, new stitches arise little by little on the third knitting needle and slip onto this third knitting needle, little by little, over the bendable shaft portion. The bendable shaft portion, or the adjoining leg, is adapted to the run of the stitches. This is precisely what is allowed by the elastic shaft portion that is bendable with little force.

The material proposed for the bendable shaft portion is synthetic polymer, particularly nylon, which achieves the described bendability and is otherwise also readily suitable for carrying stitches. However, other materials with the same or similar properties are also suitable. Very generally, a suitable material is synthetic polymer, in particular polyamide, particularly the abovementioned nylon. Further examples are Perlon and Dederon.

In a further advantageous embodiment, it is proposed that the two legs and the shaft portion be formed from a single material throughout. This is particularly advantageous, since the knitting needle can be produced from a single knitting-needle blank and also no joining edges, on which fine knitting material such as wool can catch, form between the legs and the shaft portion. In this case, the material proposed for a knitting needle made from a single material throughout is the same as already proposed above for the bendable shaft portion, since, with these materials, in particular the shaft portion can be formed in a bendable manner and the legs in a rigid manner. This can be achieved by different thicknesses of the shaft portion, for the one part, and of the two legs, for the other part. If the legs are thick enough, they are scarcely bendable.

Preferably, it is proposed that the two legs have different lengths and/or thicknesses, such that the knitting needle has a longer leg and a shorter leg, or a thinner leg and a thicker leg. During knitting, one of the two legs can act as the stitch-supplying leg and the other as the stitch-slipping leg. If the legs are formed differently, they can be adapted better to these two functions.

Furthermore, it has been recognized that there are regional differences or different knitting styles in the production of knitted products with knitting needles. These result in differently tight stitches. This can be compensated particularly by differently thick legs, if the thicker leg is used as the slipping leg for the knitting style that results in tight stitches. Moreover, individually better adapted legs of the knitting needles for the different knitting styles or body sizes of the users can be provided, thereby simplifying the handling of the knitting needles for the user.

In a further embodiment, it is proposed that at least one of the two legs and the shaft portion be connected releasably together via a closure device. In this case, in a particular embodiment, the closure device is in the form of a bayonet coupling, which comprises at least one insertion element and a receiving element. The receiving element is designed to receive the insertion element, and the insertion element has a guide slot which can comprise in particular a longitudinal slot, a transverse slot and a latching slot. The receiving element can have a spring device and a catch. Particularly, it is proposed that the receiving element be arranged on one leg, or on both legs in each case. The insertion element can then be arranged on the bendable shaft portion, or two insertion elements are provided on the bendable shaft portion, specifically one on each end, when the knitting needle has two closure devices. According to one embodiment, it is proposed that the closure device be in the form of a screw device, such that the bendable shaft portion is screwed into one of the two legs with at least one side in each case, or, conversely, the particular leg is screwed into the bendable shaft portion with one side.

Preferably, the knitting needle is characterized in that the bendable shaft portion is formed integrally from one material and the at least one insertion element is in the form of an insertion portion. In this case, particularly the bendable portion can be formed in a somewhat thicker manner at its ends and have in each case an insertion portion there, into which the guide slot can be worked.

A knitting needle having such a coupling device has the advantage that the legs are connected releasably together by way of the bendable shaft portion, and thus one leg or the shaft portion can be exchanged. It is also possible for legs of different lengths and/or thicknesses to be connected as desired.

Preferably, in each case one leg is fixedly connected to the bendable shaft portion such that only one leg can be changed and thus changed in size.

According to one embodiment, it is proposed that the bendable shaft portion have a variable length, in particular such that it can be pulled apart and pushed back together and in the process accordingly changes its length plastically, while at the same time it remains bendable, in particular elastically bendable. This can be achieved for example in that the bendable shaft portion has a bendable corrugated tube portion, as in a bendable drinking straw, particularly one as was developed by Horst Veith. Preferably, this corrugated tube portion is produced from plastic, in particular from a thermoplastic. Preferably, the same material is chosen as in the known bendable drinking straw. In order to allow the stitches to slip over this corrugated tube portion, an elastic coating can be provided, which allows the corrugated tube portion to be stretched and compressed. Sliding can also be achieved in that an elastic hose portion covers the corrugated tube portion.

BRIEF DESCRIPTION OF THE SEVERAL VIEWS OF THE DRAWINGS

The present disclosure will now be explained in more detail in the following text by way of example on the basis of exemplary embodiments with reference to the list of reference signs and the accompanying figures.

DETAILED DESCRIPTION

Figure 1:
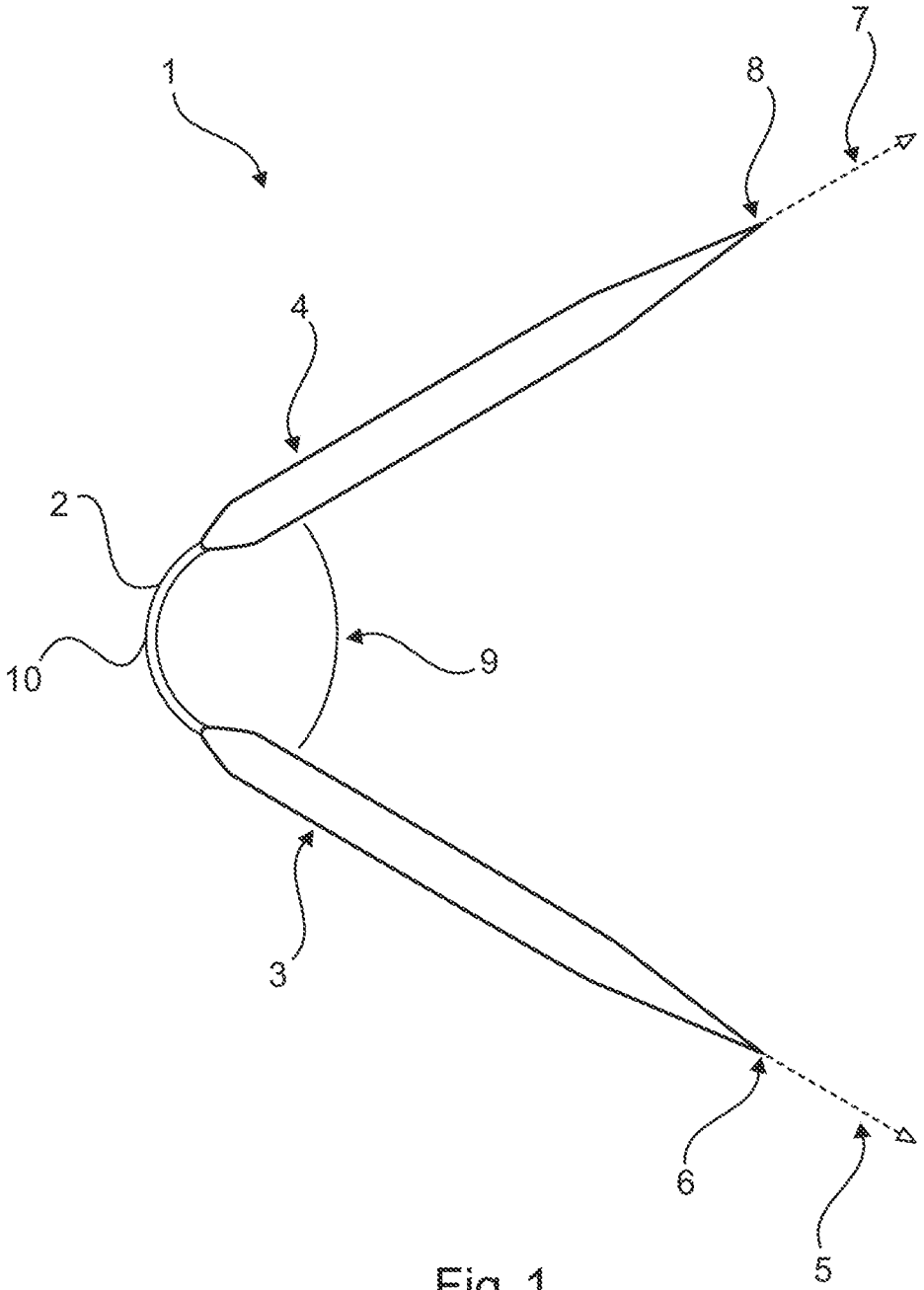
FIG. 1 shows an embodiment of a knitting needle with a bendable shaft portion, in particular a sock knitting needle.

FIG. 1 shows a knitting needle 1, in particular a sock knitting needle, having a shaft portion 2 and a first and second leg 3 and 4. The first leg 3 has a first extension direction 5. The second leg 4 has a second extension direction 7. Furthermore, the two legs 3 and 4 have a first free end, namely the leg 3 has the first free end 6 and the leg 4 has the second free end 8. On account of the bendable shaft portion 2, a variable angle 9 is formed between the two legs 3 and 4 with regard to the center of gravity 10.

Figure 2:
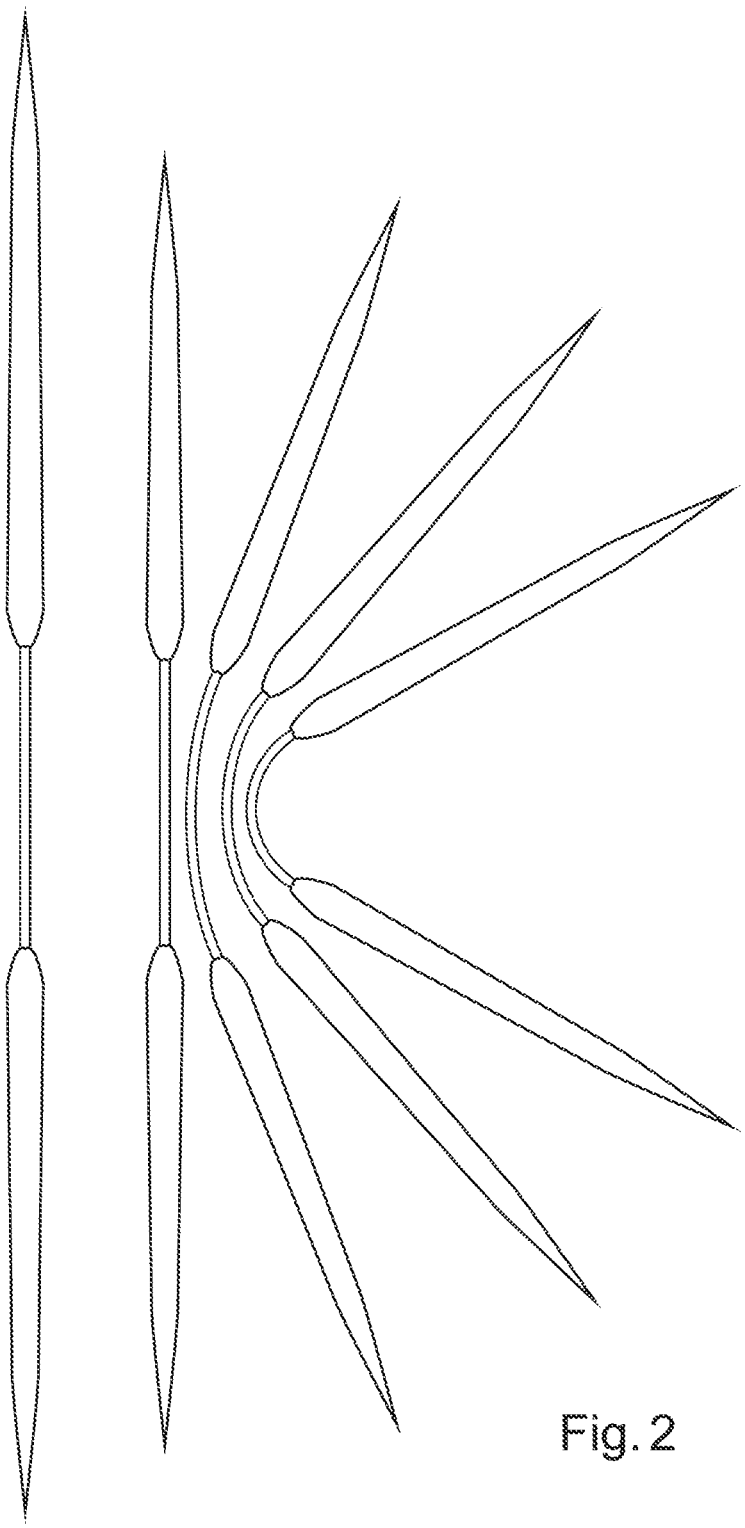
FIG. 2 shows an exploded view of a knitting needle with a bendable shaft portion.

FIG. 2 shows an exploded view of a sock knitting needle 1, in which the variable angle 9 with regard to the center of gravity 10 on the bendable shaft portion decreases from left to right, i.e., the variable angle becomes increasingly acute from left to right.

Figure 3:
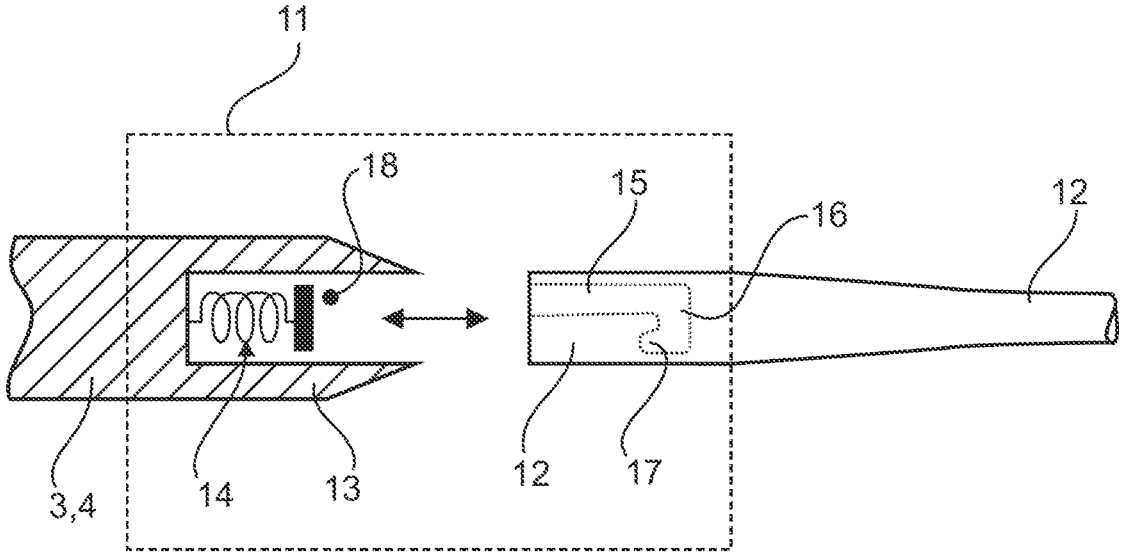
FIG. 3 shows an embodiment of a closure device of a knitting needle, which is in the form of a bayonet coupling.

FIG. 3 shows a knitting needle 1, wherein one of the two legs 3, 4 and the shaft portion 2 are connectable releasably together via a closure device 11. In FIG. 3, the closure device is formed for example as a bayonet coupling. This has an insertion element 12 and a receiving element 13. In this case, the receiving element is designed to receive the insertion element, for example in that the receiving element has a cavity for the insertion of the insertion element. The shown insertion element has a longitudinal slot 15, a transverse slot 16 and a latching slot 17, through and into which, respectively, a catch can be pushed. The receiving element has a spring device 14 and a catch 18. Thus, the insertion element 12 and the receiving element 13 are connectable releasably together along their longitudinal axis, as is indicated by the double-headed arrow in FIG. 3.

In order for example to connect the insertion element 12 and the receiving element 13 together, the catch 18 is first of all pushed through the longitudinal slot 15, with the spring element 14 undergoing compression in the process. Once the catch 18 has been inserted along the longitudinal slot as far as the transverse slot, the catch is displaced along the transverse slot by the insertion element or receiving element being rotated. Once the catch 18 then reaches the latching slot 17, the spring element relaxes somewhat, such that the catch latches in place and the insertion element and receiving element are connected together. Should the connection need to be released again, the catch is pushed out along the slots 17, 16 and 15 in the reverse sequence.

The longitudinal slot 15, the transverse slot 16 and the latching slot 17 together form a guide slot. A particularly advantageous feature of this design is that the guide slot can also be formed on an insertion element with a small diameter and that only this guide slot, which is purely passive, is required for the closure device on the insertion element 12. It is also possible to form the guide slot in the same material, which has the bendable shaft portion. As a result, it is possible to equip the knitting needle with one closure device or two closure devices, while the bendable shaft portion can be produced integrally from one material. Preferably, the bendable shaft portion has, in this case, a larger diameter in the region of the insertion element 12 than in a central region of the bendable shaft portion.

LIST OF REFERENCE SIGNS

1 Knitting needle
2 Shaft portion
3 First leg
4 Second leg
5 First extension direction
6 First free end
7 Second extension direction
8 Second free end
9 Variable angle
10 Center of gravity
11 Closure device
12 Insertion element
13 Receiving element
14 Spring device
15 Longitudinal slot
16 Transverse slot
17 Latching slot
18 Catch The various embodiments described above can be combined to provide further embodiments. All of the U.S. patents, U.S. patent application publications, U.S. patent applications, foreign patents, foreign patent applications and non-patent publications referred to in this specification and/or listed in the Application Data Sheet are incorporated herein by reference, in their entirety. Aspects of the embodiments can be modified, if necessary to employ concepts of the various patents, applications and publications to provide yet further embodiments.

These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

The invention claimed is:

1. A method of using a three needle set of double pointed knitting needles for producing cross-sectionally round knitted products, comprising:

providing first, second, and third double pointed knitting needles, each of the three double pointed knitting needles including (1) a first double pointed knitting needle leg extending in a variable manner from a bendable shaft portion in a first extension direction to a first free end, and (2) a second double pointed knitting needle leg extending in a variable manner from the bendable shaft portion in a second extension direction to a second free end;

casting initial stitches onto the first double pointed knitting needle and the second double pointed knitting needle;

carrying the initial stitches on the first double pointed knitting needle and the second double pointed knitting needle; and knitting additional stitches using one double pointed knitting needle leg of the third double pointed knitting needle and one double pointed knitting needle leg of one of the first double pointed knitting needle and the second double pointed knitting needle.

2. The method of claim 1, wherein the shaft portion of each double pointed knitting needle is formed in a bendable manner, wherein the shaft portion consists of flexible synthetic polymer, and is fastened to the respective legs of each double pointed knitting needle.

3. The method of claim 1, wherein the free ends of the double pointed knitting needle legs are in the form of rounded tips.

4. The method of claim 1, wherein the shaft portion consists of a flexible synthetic polymer.

5. The method of claim 1, wherein the shaft portion has a length of 3-7 cm.

6. The method of claim 1, wherein the shaft portion has a length of 3-5 cm.

7. The method of claim 1, wherein the shaft portion and the two legs have a cylindrical cross section, wherein the free ends taper toward an outside in cross section.

8. The method of claim 1, wherein each of the first and second double pointed knitting needle legs is a same length, and each of the first and second double pointed knitting needle legs is a length of 5 cm to 15 cm.

9. The method of claim 1, wherein the each of the first and second double pointed knitting needle legs and the shaft portion are formed from a single material throughout, wherein the single material is a synthetic polymer.

10. The method of claim 1, wherein the first and second double pointed knitting needle legs have different lengths, different thicknesses, or both.

11. The method of claim 1, wherein at least one of the first and second double pointed knitting needle legs and the shaft portion are connectable releasably via a closure device.

12. The method of claim 11, wherein the bendable shaft portion is formed integrally from one material and the at least one insertion element is in the form of an insertion portion.

13. The method of claim 1, wherein the bendable shaft portion has a variable length, wherein the bendable shaft portion can be pulled apart and pushed back together, thereby plastically changing its length.

14. The method of claim 2, wherein the flexible synthetic polymer is a nylon or nylon-coated wire mesh.

15. The method of claim 8, wherein each of the first and second double pointed knitting needle legs is a same length, and wherein each of the first and second double pointed knitting needle legs has a length of 7 cm to 8.5 cm.

16. The method of claim 9, wherein the first and second double pointed knitting needle legs and the shaft portion are formed from a single material throughout, wherein the single material is a polyamide.

17. The method of claim 16, wherein the first and second double pointed knitting needle legs and the shaft portion are formed from a single material throughout, wherein the single material is nylon.

18. The method of claim 11, wherein the closure device is a bayonet coupling, which has at least one insertion element and a receiving element, wherein the receiving element is designed to receive the insertion element, and wherein the insertion element has a guide slot with a longitudinal slot, a transverse slot, and a latching slot, and wherein the receiving element has a spring device and a catch.

19. The method of claim 13, wherein the bendable shaft portion is elastically bendable, and has a bendable corrugated tube portion.

* * * * *